United States Patent [19]

Duddy

[11] Patent Number: 4,759,092

[45] Date of Patent: Jul. 26, 1988

[54] INDUSTRIAL-TYPE SCRAPER

[76] Inventor: James J. Duddy, 514 N. Medcalf St., Lima, Ohio 45801

[21] Appl. No.: 81,725

[22] Filed: Aug. 5, 1987

[51] Int. Cl.[4] ..... B44D 3/16

[52] U.S. Cl. ..... 15/236 R; 30/169

[58] Field of Search ..... 15/236 R, 145; 30/169

[56] References Cited

U.S. PATENT DOCUMENTS

| | | | |
|---|---|---|---|
| 161,181 | 3/1875 | Tuckerman | 30/172 X |
| 698,849 | 4/1902 | Ouellette | 15/236 R X |
| 1,171,738 | 2/1916 | Mallet | 15/236 R X |
| 1,488,957 | 4/1924 | Verheyden . | |
| 2,179,758 | 11/1939 | Schlueter | 15/236 R X |
| 2,524,475 | 10/1950 | Renz | 15/236 R X |
| 2,693,029 | 11/1954 | Kass | 30/171 X |
| 3,795,026 | 3/1974 | Kazamek et al. | 15/236 R |
| 4,200,948 | 5/1980 | Nesseth | 15/236 R |

FOREIGN PATENT DOCUMENTS

| | | | |
|---|---|---|---|
| 74249 | 2/1917 | Switzerland | 15/236 R |
| 289145 | 6/1953 | Switzerland | 15/236 R |

*Primary Examiner*—Chris K. Moore

*Attorney, Agent, or Firm*—C. Hercus Just

[57] ABSTRACT

An industrial-type scraper provided with an elongated handle to one end of which a flat support plate of substantially less length than the handle is connected to the handle at an obtuse angle thereto in side view and also at an additional obtuse angle to the handle in plan view, a flat clamping plate of similar size as the support plate, bolt and wing nut members extending through similar complementary size aligned holes in the support and clamping plates, and a sawtooth edged scraping blade clamped between said plates with its sawtooth edge projecting beyond one of the edges of the aforementioned plates.

5 Claims, 1 Drawing Sheet

INDUSTRIAL-TYPE SCRAPER

BACKGROUND OF THE INVENTION

This invention pertains to an industrial-type scraper of the type used in connection with house painting, automobile body repairs and the like, and particularly in situations where loose paint requires removal. Also, in body repair work in garages and the like, dented and other irregular surfaces frequently are filled with a type of settable material which is applied in excess to that which ultimately is required and much of the excess can be removed by use of a scraper of the type to which the invention pertains, after which a finished surface for painting may be produced by the use of the devices, such as sanding discs and the like.

Scrapers of various kinds have been in use for many years. During that period, various types of scrapers have been developed and especially those for use in removing rust or loose paint preparatory to applying new paint. The following patents are representative of various types of so-called paint scrapers that have been developed during the past fifty or more years:

U.S. Pat. No. 1,488,957—Verheyden Apr. 1, 1924
U.S. Pat. No. 2,693,029—Kass Nov. 2, 1954
U.S. Pat. No. 3,795,026—Kazamek et al Mar. 5, 1974
U.S. Pat. No. 4,200,948—Nesseth May 6, 1980

Among the foregoing patents, those to Kass and Kazamek et al illustrate devices in which serrated edged blades are employed in a suitable holder and Nesseth also shows a serrated edged blade supported in a flat holder within a complementary channel.

The present invention, while primarily comprising a paint scraper, offers advantages and improvements over the devices illustrated in the foregoing patents, both in regard to structure as well as use, details of which are set forth below.

SUMMARY OF THE INVENTION

It is the principle object of the present invention to provide a scraper having an elongated handle, and especially one, such as of the order of twelve or more inches, which permits, for example, a painter on a high ladder being capable of scraping paint at appreciable distances on either side of him.

Another object is to provide on the outer end of the handle a support plate which preferably is rectangular in size and of a length substantially less than that of the handle, and in order to provide a compound scraping effect, the support plate is disposed at an obtuse angle to the axis of the handle in plan view, and in side view, the support plate is at a slightly larger obtuse angle, and when a blade is clamped to said support plate by a clamping plate of similar size to the support plate, a blade having a serrated edge projecting beyond the two plates, when clamped therebetween, provides a highly effective and efficient scraping tool, not only for use in removing paint, but also other materials requiring removal, such as that applied to dents and uneven surfaces in automobile body repair operations.

A further object of the invention is to provide a handle which preferably, at least on the end which is connected to the support plate, is square in cross-section, and the outer face of said end is disposed at obtuse angles respectively in plan and side views which correspond to those described above with respect to the support plate and its relationship to the axis of the handle, thereby providing means to aid in maintaining the support and clamping plates in the these desired angles over long periods of use.

Still another object of the invention is to provide the support plate intermediately of its opposite ends with a tongue that is bent at an obtuse angle to said plate and said tongue is affixed to the outer end of the handle by preferably fixed means, such as a bolt and nut, the tongue being disposed in flat relationship to one surface of the end of the handle to which the scraper is affixed.

One further object of the invention is to secure the clamping plate to the support plate preferably by means of a pair of short bolts and wing nuts which are adequate to securely clamp a scraping blade between the plates.

Details of the foregoing objects and of the invention, as well as other objects thereof, are set forth in the following specification and illustrated in the accompanying drawing, which comprises a part of the application.

DETAILED DESCRIPTION OF THE PREFERRED EMBODIMENT OF THE INVENTION

Figure 1:
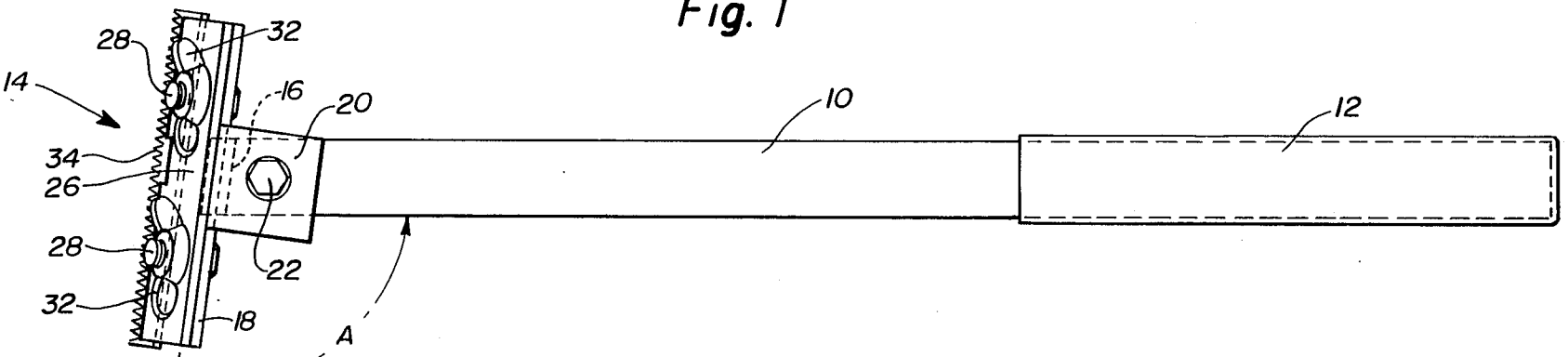
FIG. 1 is a top plan view of the scraper.
Figure 2:
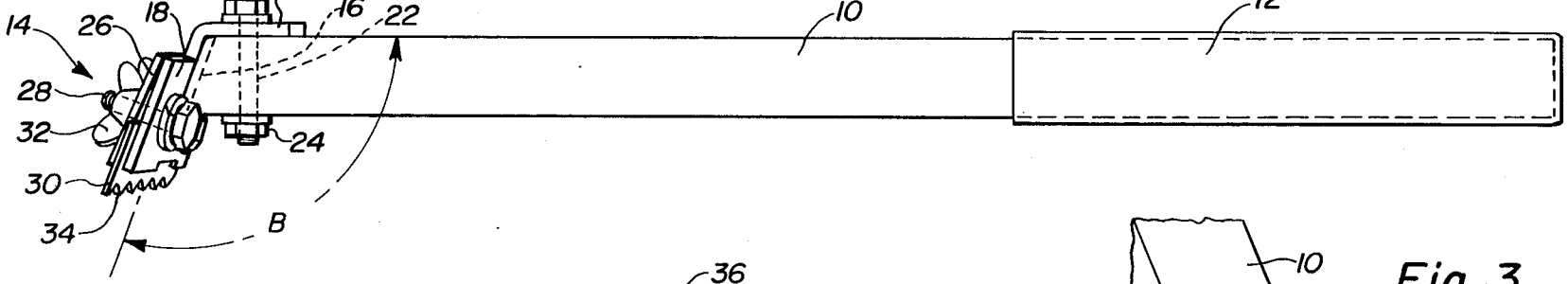
FIG. 2 is a side elevation thereof.
Figure 3:
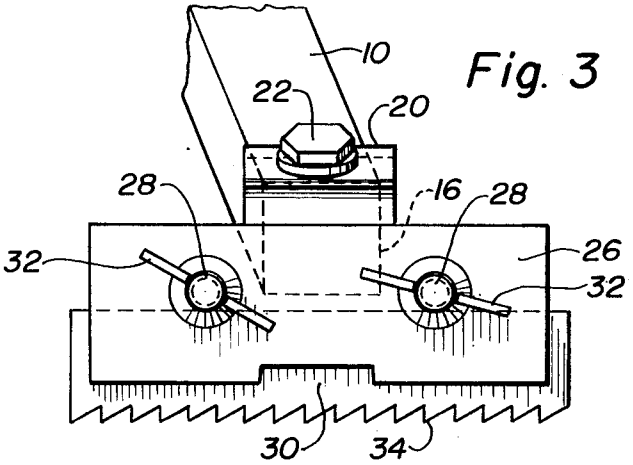
FIG. 3 is a front view of the scraper end of the device and showing an exemplary serrated tooth scraping blade clamped by the head on the outer end of the handle, which is shown fragmentarily.

Referring to FIG. 1, there is illustrated therein, a scraper comprising the present invention and in which a handle 10 is illustrated as being elongated and, without limitation thereto, one practical length has been found to be a minimum of one foot. Also, a suitable material from which the handle 10 may be formed is hard wood, such as maple, oak, or the like, and for convenience the handle may be square in cross-section and approximately ¾ inch thick in plan and side views, but without limitation thereto. One end of the handle 10 may have a coating 12 applied thereto, especially of a suitable substance to provide a friction grip. The opposite end of the handle has a support and clamping head 14 attached thereto, details of which are as follows:

The head 14 is secured to the outer end of the handle 10, the outer face 16 of which is disposed at an obtuse angle B in side view, as seen in FIG. 2, and also at an additional obtuse angle A in plan view, as shown in FIG. 1. The head 14 comprises a support plate 18, which is flat and also flatly abuts the outer face 16 of the handle and it also is at the obtuse angle B in side view, and the obtuse angle A in plan view, with respect to the axis of the handle 10.

The support plate 18 is firmly affixed to the outer end of the handle opposite the coated end 12 in firm abutment with the outer face 16 of the handle by means of an ear 20, which is bent at the obtuse angle B with respect to the support plate 18 and a headed bolt 22 extends through aligned holes in the ear 20 and handle 10 to securely affix the support plate 18 to the handle by means of a nut 24.

The head 14 also comprises a clamping plate 26 which preferably is of the same rectangular shape as the support plate 18. Aligned pairs of holes are formed respectively in the support and clamping plates 18 and 26 through which additional bolts 28 extend and, to effect firm clamping of a blade 30 between said plates, wing nuts 32 are used to effect the clamping of the blade.

By way of illustration but without exact limitation thereto, it has been found that if the obtuse angle A is of the order of approximately 100° and the obtuse angle B is of the order of approximately 110°, when the scraper is used in a pushing direction, especially in the line of the axis of the handle, a somewhat compound scraping movement is effected which tends to direct the scraped material to one side, such as the right side of the plan view illustrated in FIG. 1, thereby assisting in clearing the removed material from the area of operation.

Figure 4:
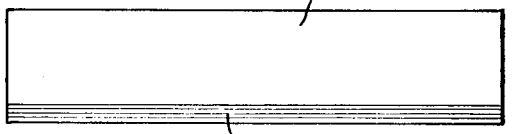
FIGS. 4 and 5 are plan views of exemplary smooth-edged and serrated edged blades which the invention is capable of having secured between the support and clamping plates of the head.
Figure 5:
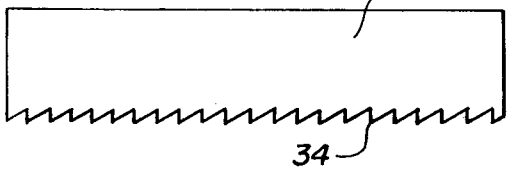

In FIGS. 1–3 and 5, a blade 30 is illustrated with a sawtooth edge 34, and such an edge is highly effective for rapid removal of rust, loose paint, excess filling material and the like. Without restriction thereto, one highly suitable type of serrated edged blade is a section of a band saw blade of appropriate length. However, as shown in FIG. 4, the blade 36 has a straight edge 38, and especially for more finishing type of operations, a straight edge blade might be preferable to the serrated edge 34 of blade 30.

From the foregoing, it will be seen that the scraper structure described in detail above and illustrated in the drawing comprises a highly effective type of scraper for use in removing loose paint, excess filling material and the like. In conjunction with the relatively long handle, an extensive area of operation may be performed, for example, when at a high elevation on a ladder against a house surface, and removal of loose paint or the like is being undertaken. The several obtuse angles also afford certain advantages as described above and the entire device is of sturdy construction and capable of long life.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An industrial-type scraper comprising in combination, an elongated handle, a flat rectangular support plate of substantially less length than said handle connected intermediately of its ends to one end of said handle, said support plate being disposed at an obtuse angle in side view of the handle and also at an obtuse angle to the handle in plan view thereof, a flat clamping plate similar in size to said support plate, a pair of bolt and nut means extending through aligned holes in said plates, and a scraping blade clamped between said plates with a sawtooth edge on said blade projecting beyond a pair of clamped edges of said plates.

2. The industrial-type scraper according to claim 1 further characterized by said support plate having an ear intermediately of the edge thereof opposite the clamping edge bent at an obtuse angle to the plane of said support plate, and means affixing said ear to said one end of said handle.

3. The industrial-type scraper according to claim 2 in which at least said end of said handle to which said support plate is connected is substantially square in cross-section and said ear of said support plate is connected to the normally upper flat surface of said square end of said handle.

4. The industrial-type scraper according to claim 1 in which the end of said handle which is connected to said support plate is formed with an outer face disposed at obtuse angles respectively in plan and side views of said handle, and said support plate flatly abutting said outer face of said handle when affixed thereto.

5. The industrial-type scraper according to claim 1 in which the obtuse angle in side view is substantially 110° to the axis of the handle and the obtuse angle in plan view is substantially 100° to the axis of the handle.

* * * * *